8-107 SR
FIP8309 XR 4,312,634

United States Patent [19]
Katz

[11] 4,312,634
[45] * Jan. 26, 1982

[54] METHOD FOR TREATING CELLULOSIC MATERIALS PRIOR TO BLEACHING

[76] Inventor: Jerome Katz, P.O. Box 1544, Rochester, N.Y. 14603

[ * ] Notice: The portion of the term of this patent subsequent to Nov. 29, 1994, has been disclaimed.

[21] Appl. No.: 85,280

[22] Filed: Oct. 16, 1979

Related U.S. Application Data

[63] Continuation of Ser. No. 855,354, Nov. 28, 1977, abandoned, and a continuation-in-part of Ser. No. 609,734, Sep. 2, 1975, Pat. No. 4,060,385, and Ser. No. 609,735, Sep. 2, 1975, Pat. No. 4,060,386, which is a continuation-in-part of Ser. No. 312,637, Dec. 6, 1972, Pat. No. 3,918,898.

[51] Int. Cl.[3] ..... D06L 3/02
[52] U.S. Cl. ..... 8/111; 8/101; 8/107; 8/125; 8/127; 8/139
[58] Field of Search ..... 8/111, 107, 139, 101, 8/125, 127

[56] References Cited

U.S. PATENT DOCUMENTS

| | | | |
|---|---|---|---|
| 2,173,474 | 9/1939 | Erov | 8/111 |
| 2,283,141 | 5/1942 | Kauffmann et al. | 8/111 |
| 2,970,882 | 2/1961 | Kumin | 8/125 |
| 3,193,445 | 7/1965 | Parker | 8/111 |
| 3,198,597 | 8/1965 | Grunert et al. | 8/125 |
| 3,234,124 | 2/1966 | Irani | 8/101 |
| 3,280,039 | 10/1966 | Smolens | 8/111 |
| 3,281,202 | 10/1966 | Helmick et al. | 8/139 |
| 3,345,303 | 10/1967 | Schmid et al. | 8/111 |
| 3,353,903 | 11/1967 | Potter et al. | 8/107 |
| 3,370,911 | 2/1968 | Westall | 8/125 |
| 3,756,774 | 9/1973 | Kirner | 8/111 |
| 4,060,385 | 11/1977 | Katz | 8/111 |
| 4,060,386 | 11/1977 | Katz | 8/111 |

FOREIGN PATENT DOCUMENTS

| | | | |
|---|---|---|---|
| 466112 | 5/1973 | United Kingdom | 8/111 |

*Primary Examiner*—Maria Parrish Tungol
*Attorney, Agent, or Firm*—Sixbey, Friedman & Leedom

[57] ABSTRACT

Chemical bleaching pretreatment processes are provided for cotton goods and other cellulosic materials which have the effect of enhancing the bleached cloth whiteness levels and/or reducing the bleaching time or intensity. The goods may be pretreated by intimately contacting them, as by immersion in a bath, in an alkaline scour solution having a pH of 10 to 14 and a temperature of 160°-212° F. for from 5 seconds to 3½ minutes. A second and separate pretreatment involves immersing the goods in such an alkaline scour solution and, immediately prior or subsequent thereto, in an acid solution having a pH less than about 3 at a temperature in the range 45° to 212° F. for from 1 to 10 seconds. Optionally, either the alkaline scour pretreatment or the combination acid/alkaline scour pretreatment may be preceded by an up to 3½ minute water dip or rinse in water ranging from just above ambient to 212° F. In some cases the water dip or rinse without alkaline scour or acid/alkaline scour may constitute the entire bleaching pretreatment.

38 Claims, 6 Drawing Figures

METHOD FOR TREATING CELLULOSIC MATERIALS PRIOR TO BLEACHING

CROSS-REFERENCE TO RELATED APPLICATIONS

This application is a continuation of Ser. No. 855,354, filed on Nov. 28, 1977, now abandoned which was a continuation-in-part of my applications Ser. Nos. 609,734 and 609,735, both filed Sept. 2, 1975, now U.S. Pat. No. 4,060,385 and U.S. Pat. No. 4,060,386, each of which was a continuation-in-part of application Ser. No. 312,637, filed Dec. 6, 1972, now U.S. Pat. No. 3,918,898.

BACKGROUND TO THE INVENTION

1. Field of the Invention

The present invention relates to the bleaching of cotton griege goods, cotton blends and selected other cellulosic materials and, more particularly, to methods of treating the materials prior to bleaching to enhance the resulting bleached cloth whiteness or to reduce the bleaching time or intensity.

2. Description of the Prior Art

The chemical bleaching of cotton goods is, of course, very well known and extensively practiced in various forms using a miscellany of chemical bleaches and additives thereto, and employing various types and forms of batch and continuous bleaching equipment. The purpose of these processes is, generally, to achieve a minimum preselected whiteness level for the bleached goods in as economical and environmentally safe a manner as is possible. To this end, most conventional bleaching processes known to the art employ sodium hypochloride, hydrogen peroxide, peracetic acid, percarbonates, fluorine or hydrofluoric acid, sulfite, or the like, as primary bleaching agents at selected acid or alkaline pH levels and at temperatures ranging from about room temperature up to temperatures well in excess of the boiling point of water at atmospheric pressure. To enhance the effectiveness of these bleaching process or to achieve certain economics or advantages, typical processes employ additives in the bleach baths as buffers, stabilizers wetting agents, chelating agents, and the like, most of which additives are very well known to the art. However, experience has shown that for all the good that such additives are alleged to do, they also do quite a bit of harm. Thus, even the most innocuous of additives have been found to cause violent foaming, weaken the cloth, deplete chemical bleaching agent at unacceptably rapid rates, cause motes, form deposits on the cloth or bleach equipment, be environmentally harmful, or create various other commercially unacceptable conditions.

One of the oldest techniques for enhancing the bleaching process is to pretreat the goods prior to actual bleaching. Depending, of course, upon the precise nature of the goods, pretreatments may be intended to serve specific identifiable purposes. However, as a general rule, the pretreatments serve to remove fats, waxes, starches and other non-cellulosic materials from the cotton goods. Often the pretreatments have been denominated as "desizing" or "scouring"; however, those names have come to be loosely employed and meaningless in the art unless associated with some specific purpose and pretreatment process which sets forth and identifies the chemicals and steps employed, the parameters such as pH, temperature, pressure and concentration, and the pretreatment time. Historically, the most frequently used pretreatments were the severe caustic or lime boils in which the goods were boiled at 15–35 psi in caustic or calcium soda for 4–12 hours. A more modern counterpart of the caustic scours is one in which the goods are impregnated with caustic soda and then steamed at 100° C. for 30–60 minutes. Acid pretreatments are also historically well known, for example, steeping the goods in sulfuric or phosphoric acid for 3–4 hours at room or higher temperature. Other popular pretreatments include immersing the goods in wetting agents, such as turkey red oil or sulfonates, or in enzymes. Steaming the goods prior to bleaching, either as a separate step, or, more commonly, in association with an alkaline bath impregnation or pretreatment, appears to have been a popular and widely used pretreatment procedure. Notwithstanding that these pretreatments may indeed have accomplished their intended objective, such as decreasing bleaching time or enhancing bleached goods whiteness levels, they typically have been and are extraordinarily wasteful of chemicals, and almost without exception have required high temperatures or application for extended periods of time. Thus, although the prior art pretreatments seem to produce some useful results, in fact there are very few net economies associated with any of them. Moreover, subjecting cellulosic goods for extended time periods to highly acidic or highly caustic solutions, or to prolonged high temperature steam treatment, cannot help but weaken the fibers and have an adverse effect upon the tear strength of the goods which ultimately emerge from the bleaching process.

SUMMARY OF THE INVENTION

It is, therefore, an object of the present invention to provide a method for pretreating cotton goods and other selected cellulosic materials prior to bleaching in an energy and environmentally efficient manner which permits attainment of enhanced bleached goods whiteness levels or allows a reduction in bleaching time or intensity.

It is another object of the invention to provide chemical bleaching pretreatment methods applicable primarily to cotton and cellulosic goods in which the pretreatment times are so short that any potentially detrimental effects of the pretreatment conditions are obviated.

It is still another object of the invention to provide chemical bleaching pretreatment methods involving short term water dips or alkaline baths or acid-alkaline bath pH cycling which shorten the necessary bleaching time to achieve any predetermined whiteness level or enhance the bleached goods whiteness level for any predetermined set of bleaching process parameters.

It is a most important object of the invention to provide a method of bleaching cotton, cotton blend, or other selected cellulosic materials in any conventional chemical bleaching system to at least commercially acceptable whiteness levels by pretreating the goods in accordance with the present invention and then bleaching the goods in such a manner that the total goods treatment times are less than about 30 minutes and, more desirably, less than about 7 to 15 minutes.

It is yet another object of the invention to provide a rapid, efficient, total bleaching method, preferably employing a hydrogen peroxide bleaching bath and the pretreatments of the present invention, which, by virtue of judicious selection of pretreatment and bleaching parameters and the use of continuous pretreatment and bleaching bath replenishment, can produce very high goods whiteness levels in extremely short periods of time.

Other objects and advantages will become apparent from the following description and appended claims.

Briefly stated, the aforesaid objects are accomplished by treating cotton or cotton blend cloth or other selected cellulosic materials prior to bleaching (i.e., pretreating) by subjecting the cloth or materials to very brief water dips; to alkaline scouring baths at pH 10–14 and temperatures of 160°–212° F. for times up to 3½ minutes; or to alkaline scouring baths followed or preceded by acid dip baths at pH levels up to 3.0, preferably 0.5 to 3.0, and at temperatures from 45° to 212° F. for times of from 1 to 10 seconds. It has been surprisingly found that these very short bleaching pretreatments so condition the cloth prior to bleaching as to eliminate completely the need for the expensive and difficult intensive alkaline scours, long-term acid steeping, steaming, enzymes, soaking, and the like pretreatments taught in the prior art while achieving at least comparable, if not better, results in terms of bleached goods whiteness levels or reduced bleaching times. At the same time the very short times involved conserve chemicals, energy and manpower and contribute substantially to the overall economics of the bleaching process. In particular, extraordinarily short pretreatment times leading to extraordinarily brief bleaching times have been consistently achieved utilizing the acid dip/alkaline scour bath combination pretreatment of the present invention to create an explosive pH cycling effect leading to overall treatment times as short as 2–3½ minutes to achieve very high whiteness levels.

The bleaching pretreatments of the present invention can, as has been suggested, be employed with any chemical bleaching system suitable for the cellulosic material to be bleached. However, best results in terms of shortest several goods treatment times and most advantageous bleaching economics have been experienced when the pretreatments are used in conjunction with a hydrogen peroxide bleaching bath solution having a pH in the range 2–14, a temperature in the range from about 160° to 212° F., and a hydrogen peroxide concentration by volume of from 0.25 to 70%. Most desirably, although not necessarily, the bleaching solution is maintained substantially free of heavy metal ions and free of additives other than pH adjustors, i.e., free of stabilizers, buffers, etc. The bleaching solution, and preferably the pretreatment baths as well, is recycled, filtered and/or purified, and replenished as necessary to maintain the composition and volume in contact with the goods substantially constant and preferably substantially free of heavy metal ions.

BRIEF DESCRIPTION OF THE DRAWINGS

The foregoing and other objects and advantages of the present invention will become more readily apparent from the following description considered in conjunction with the accompanying drawings, in which.

DETAILED DESCRIPTION OF THE INVENTION

In its broadest aspects the present invention provides bleaching pretreatment methods applicable to cotton goods, cotton blend, wood pulp and other cellulosic material which are substantially independent of the chemical bleaching solution and/or bleaching equipment employed in the actual bleaching operation. Thus, as has been previously pointed out, any chemical bleaching solution suitable for the goods to be treated is likewise suitable for use in connection with the present invention. The same, of course, is true for bleaching equipment, it not being particularly pertinent to the broad aspects of this invention whether the bleaching step is accomplished in a batch-wise or continuous manner, or whether J-boxes, kiers, dip-storage tanks, or any other conventional equipment is employed. That is not to say that the beneficial results attributable to the pretreatments of the present invention are always attainable to the same extent with each and every bleaching system employed. Obviously there are preferred combinations of bleaching pretreatments and bleaching solutions for any particular purpose and for various cloths and the most advantageous combination for any particular purpose is best determined by routine trial and error. Inasmuch as the most generally preferred bleaching solution for use in accordance and in conjunction with the present invention is a 0.25 to 70% by volume hydrogen peroxide aqueous solution at pH 2–14, and 160° F. to 212° F., the invention is herein described and illustrated using hydrogen peroxide bleaching solutions. However, it should be understood and appreciated that the reason for this is descriptive simplicity and ease of understanding and that the use of hydrogen peroxide bleaching systems in the following description is intended only as an indication of a preferred embodiment and not as a limitation on the scope of the invention.

Figure 1:
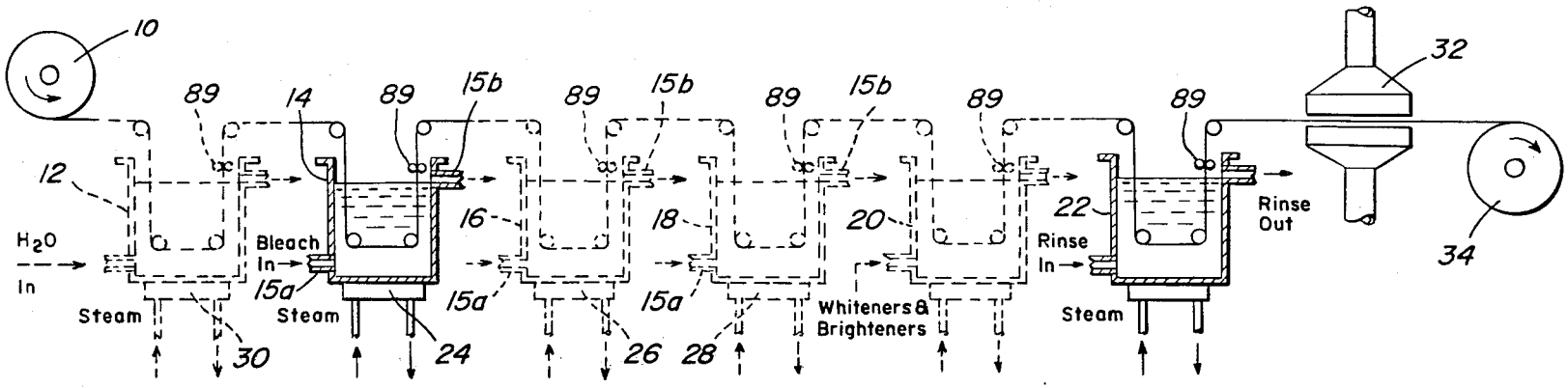
FIG. 1 is a schematic diagram illustrating a typical bleaching method useful in conjunction with the bleaching pretreatments of the present invention, with optional steps shown in phantom.

Before embarking upon a detailed discussion of bleaching solution pretreatments and their beneficial effects, it will be useful to have reference to FIG. 1 to understand the functioning of a typical, illustrative peroxide bleaching process. The cotton greige goods to be bleached are fed off a roll 10 into and through a series of solution containing tanks or containers 12, 14, 16, 18, 20 and 22. These containers may be of any structural material, and typically they are formed of stainless steel. In a particularly preferred form of the invention, it is desirable that the portions of the containers in contact with the solutions be formed of a non-metallic material. Glass or glass-lined metallic containers are suitable as are containers made of plastic materials, such as hard polypropylene.

If there is to be no goods pretreatment preliminary to actual bleaching, the goods are passed from roll 10 directly into the bleaching solution [which in such a case may serve as a simultaneous bleaching, scouring and desizing solution—see, e.g., U.S. Pat. Nos. 4,060,385 and 4,060,386] contained in bleach container 14 and, optionally, in additional bleach containers 16 and 18 where it appears that bleaching in a plurality of containers is preferable. The bleaching solution is circulated to and from each of these containers, preferably through a continuously or intermittently operating recirculating system which will be described hereinafter in connection with FIG. 2. In one typical bleaching process, the goods are passed to the first of three bleaching tanks or containers 14, through tank 14 and into tank 16, through tank 16 and into tank 18. The temperature of the solution in each of tanks 14, 16 and 18 is maintained within the desired range by heaters 24, 26 and 28, which may be steam operated heat exchangers. The rate of travel of the goods through the tanks may be adjusted so that when more than one bleach tank is used the sum of the contact time with the bleach solution in each tank is sufficient to provide the total desired bleaching time.

After passing through the final bleach tank 18, the goods are typically passed through a rinsing tank 22 through which rinse water is circulated, and are then dried in a drier 32 which may be of a heated air-flow type. Finally, the goods are wound on a pickup reel 34. Alternatively, the goods may be continuously fed to the next process stage, such as dying or cutting into pieces for further manufacture. If desired, the goods which exit bleaching tank 18 may be further whitened and brightened by passage through separate optional tank 20 to which are continuously fed blueing, optical brighteners, and the like, hereinafter referred to as "whitening enhancing agents," all as are well known in the art to further whiten and brighten the goods. Alternatively, these "whitening enhancing agents," when used, may be added directly to the bleaching solution in one or more of tanks 14, 16, 18, or to one of the pretreatment solutions as will appear more clearly from the description which follows.

Figure 2:
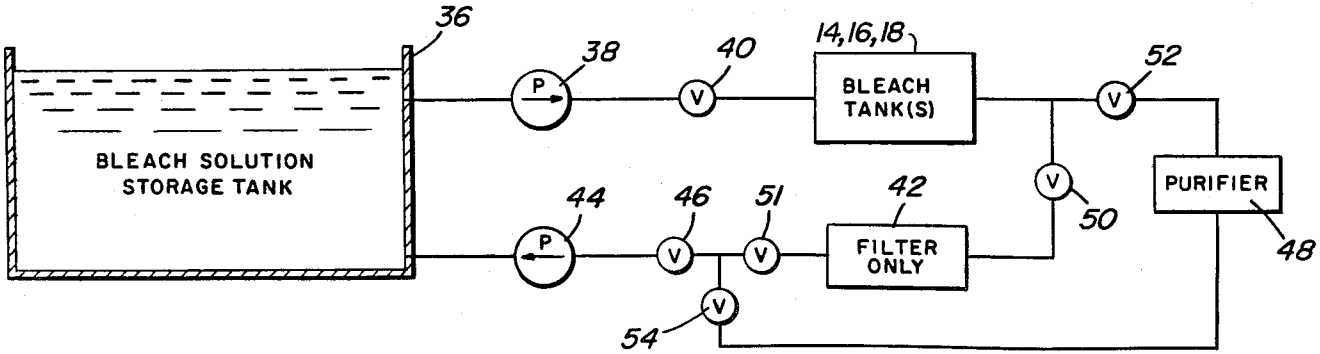
FIG. 2 is a schematic diagram in block form illustrating how the bleaching solution may be continuously or intermittently recycled in the method illustrated in FIG. 1.

Inasmuch as the bleaching processes carried on in each of the tanks, even when preliminary treatment baths are employed, results in some impurity contamination of the bleach solutions, with resulting yellowing, the system shown in FIG. 2 may be used on a continuous or intermittent basis for recirculating and reusing the bleach solutions, and by avoiding continuous dumping, for achieving pollution control. The bleach solution is stored in a storage tank 36 to which additional solution may be added to make up for evaporation and depletion, to maintain peroxide concentration, and to maintain an adequate pH. Automatic sensors may be used to provide for the introduction of make-up solution so as to maintain proper bleaching solution strength (in terms of peroxide content) and pH. In one form of bleaching process the solution is pumped by means of a pump 38; the pressure and flow of the solution being controlled by a valve 40. The valve 40 is connected by piping to the inlet pipes 15*a* of each of the tanks 14, 16, and 18. The outlet pipes 15*b* from the tanks are connected together and are piped via open valve 50 to a filter 42, which may be a mechanical filter such as a fiber or plastic screen or may be a microporous membrane. Sufficient back pressure is maintained by another pump 44 and a control valve 46. The filtered solution returns to the storage tank 36 to complete the recirculation system. After a period of use, the filter 42 may be cleaned and filtrate removed to a precipitating tank without polluting the environment in any way whatsoever.

In alternative typical bleaching processes, for example where the goods contain unusually high levels of non-cellulosic materials, or where only one bleaching tank is used, or where proper goods pretreatment is not practiced, or for a variety of other reasons, the impurities present in the cotton greige goods massively contaminate the bleach solution per se and its effectiveness rapidly depletes. In such a circumstance mere filtration alone to remove solid impurities is often insufficient to maintain the effectiveness of the solution. In such a case, the system shown in FIG. 2, with the addition of a purifier 48, which may include mechanical filter means, as necessary, through which the bleach solution may be continuously or intermittently circulated is employed to remove the non-filterable impurities from the contaminated bleach solution. When used, open flow control valves 52 and 54 direct the flow through the purifier 48 and valves 50 and 51 are closed. On the other hand, when purifier 48 is to be bypassed, valves 52 and 54 are closed and valves 50 and 51 are opened. Purification, as that term is used herein, can be accomplished by distillation, reverse osmosis or adsorption by polymer adsorbants, by a combination of such methods, or by any known purification techniques which may be necessary to remove dissolved and suspended solids and oils or other contaminants in the bleach solution. Although purification is necessary in many cases, as a general matter it is not always desirable because some purifying methods for some solutions destroy components thereof. Thus, the quantity of hydrogen peroxide which must be replenished to the system is quite large by comparison with a bleach system which employs a plurality of bleaching tanks and utilizes only filtration in lieu of purification. In connection with the latter type of system, it is noteworthy that the peroxide concentration in each of the bleach tanks, 14, 16 and 18 need not be the same. In fact, it is particularly desirable that the peroxide concentration be highest in the first bleach tank 14 in order that the major proportion of the impurities can be removed in this tank. It is also noteworthy at this point, since much of the bleaching is accomplished at the boil, that vapor from the boiling solutions can be collected and condensed as pure distilled water and either used as such or refluxed back into the bleaching make-up system to maintain parameter control. This vapor collection and water re-use applies with equal force, of course, to vapors lost from pretreatment baths as will become clearer from the description to follow. One simple way to achieve the vapor recovery is to place a vapor collector (not shown) above each bleach or pretreatment tank to lead the collected vapor to a condenser, reflux tower, or the like.

Perhaps the simplest, yet demonstrably effective goods pretreatment method useful in accordance with the present invention is a pre-bleaching soaking of the goods in warm to hot water. This can be accomplished in the system of FIG. 1 by passing the goods prior to their entering tank 14, through a water dip tank 12 for periods up to 3½ minutes, but generally from 20 seconds up to about 3 minutes, which tank may contain tap, distilled or deionized water. However, it is preferred that the water in the tank be substantially heavy metal ion free and, as in all preferred bleaching operations used in conjunction with the present invention, it is desirable, but not necessary, that the portions of the water dip tank in contact with the water be non-metallic. Preferably the water in tank 12 is maintained at an elevated temperature above room temperature and between about 104° and 212° F. by heater 30, which may be a steam operated heat exchanger. Dipping of the goods into the water in tank 12 serves to remove some of the impurities known to be present on and in the cotton goods and thereby reduces the subsequent contamination of the bleaching solutions by these impurities. Another advantage of the water dip, particularly where it is used as a first step preliminary to other goods pretreatment, is that it reduces the load on the alkaline scour or acid/alkaline scour pretreatments by removing metal ions and localizing purification needs in solutions of less complexity which are easier and cheaper to purify. However, to minimize space and equipment investment and to reduce water usage, the preliminary water dip step is often dispensed with.

In addition the water dip in tank 12, if used, brings the cotton goods up from ambient to the bleaching temperature. It will be appreciated that while the water pre-dip will remove some of the impurities on the goods, it will remove nowhere near the amount typically removed in the intensive alkaline scouring or acid steeping steps of the prior art. On the other hand, the beneficial effect on bleached goods whiteness levels achieved using a water pre-dip is remarkable in view of the simplicity and relative mildness of the treatment and, on a strictly economic basis, is far superior to and more advantageous than prior art pretreatments. In addition, those impurities which are removed in tank 12 are prevented from entering the bleaching solution which, as is now well known, rapidly becomes contaminated with impurities from the cotton goods, turning the solution yellow and diminishing the whiteness of the bleached goods. It has been found that in processes wherein the total bleaching time in hyrogen peroxide solution varies between ½ and 30 minutes, depending on process parameters, either the bleaching time and overall goods treatment time can be substantially reduced or the bleached goods "base white" or whiteness levels can be increased if the water dip in tank 12 is utilized.

One generally accepted measure of the success or extent of bleaching is measurement of the resulting fabric "base white" which can be defined as the whiteness of a piece of fabric after it has been bleached but prior to bluing or optical brightening. Whiteness is measured in terms of percentage reflection compared to some standard of pure white, such as MgO, $BaSO_4$ or Vitrolite, with respect to a source of light. The source is monochromatic and is impinged upon and reflected from the sample. Using a prism or grating, the reflected light is divided into its various components and its intensity is measured by a photocell. The comparative intensity is expressed as a percentage of the intensity of the reflection from the standard. Thus, it will be appreciated, that no matter how much a fabric has been bleached, it will never achieve a pure white shade. Its base white is always less than 100 and, in fact, its reflected color is always a shade of yellow.

The whiteness of a fabric (although not its "base white") can be increased by neutralizing the reflected yellow. Since blue is the complement of yellow, the addition of a blue dye to the fabric neutralizes the yellow while at the same time absorbing light striking it. The result is an increase in the whiteness (i.e., a decrease in the yellowness) but an over-all darkening of the color. On the other hand, flourescent whiteners absorb light mostly in the ultraviolet region and emit blue fluorescence. The blue fluorescense neutralizes the yellow and increases the whiteness of the fabric. However, there is no over-all darkening attending use of fluorescent whiteners since their absorption is primarily in the ultraviolet region and not in the visible region. In fact, as long as too much whitener is not used the effect is to increase the apparent whiteness of the fabric. As a consequence, it has been found that by a proper balance of blueing and fluorescent whiteners, a considerable whitening of the fabric can be accomplished.

The amount of whiteness desired in bleached fabric depends upon the ultimate intended usage of the fabric. Thus, if the fabric is to be color dyed, it is of no real consequence that its base white is somewhat lower than that of fabric which is not to be dyed. Generally speaking, commercially acceptable base whites are in the range 65 to 80. However, there is another aspect to commercially acceptable bleaching. Due to the presence of cotton husks or other particulate impurity matter in the unbleached, uncombed greige goods, it is possible to bleach the bulk of the cloth to a whiteness exceeding 65 while not successfully bleaching a substantial number of these particulate impurities, with the result that the cloth appears white but contains unbleached specks therein. From a practical viewpoint, a few unbleached specks per 12"×12" section of fabric are commercially tolerable because they are relatively unnoticeable and because subsequent whitening and brightening will probably remove the specks. Therefore, when commercially acceptable whitenesses or commercially acceptable bleaching is referred to herein it means a whiteness of at least 65 with no more than a few specks per 12"×12" cloth section. All base whiteness readings presented herein are minus fluorescense readings even though the goods may have been treated in a bleach or pretreatment bath which may have contained an optical brightener, fluorescent whitener, or the like.

Thus, in accordance with the present invention, a number of cotton goods samples were subjected to the bleaching pretreatments of the invention and were then bleached in hydrogen peroxide solutions with the result that at least commercially acceptable base whites were achieved within the pH, temperature, and concentration limitations of the present invention. Comparable samples, which were not subjected to the pretreatments of the present invention, generally exhibited inferior whiteness levels under comparable bleaching conditions.

The following Example I is illustrative of the present process employing a water dip pretreatment of the goods prior to bleaching.

EXAMPLE I

A number of aqueous hydrogen peroxide bleach solutions having various pH levels, all of which were substantially free of heavy metal ions, were prepared at concentration levels ranging from less than 1% by volume hydrogen peroxide up to 7.5% by volume hydrogen peroxide. The cotton greige goods were pre-dipped in heavy metal ion free water prior to bleaching. Following bleaching in a glass container, each sample was rinsed and dried and base white readings made thereon. The following Table I summarizes the pre-dip and bleach conditions and the resulting base whites.

TABLE I

| | WATER PRE-DIP | | BLEACH | | | | |
|---|---|---|---|---|---|---|---|
| | Temp. (°F.) (Approx.) | Time (Sec.) | $H_2O_2$ % by Vol. | Temp. (°F.) | pH | Time (Min) | BASE WHITE |
| (a) | 140 | 45 | .75 | 212 | 13.2 | 3½ | 75.7 |
| (b) | 212 | 10–15 | 3 | 212 | 10 | 3½ | 74.3 |
| (c) | 140 | 45 | 3 | 185 | 11.8 | 3½ | 73.4 |
| (d) | 212 | 90 | 3 | 212 | 13.25 | 3½ | 76.3 |
| (e) | 212 | 90 | 3 | 212 | 13.25 | 5 | 77 |
| (f) | 212 | 90 | 3 | 212 | 13.25 | 15 | 77 |
| (g) | 212 | 10 | 5 | 212 | 13 | 1 | 73.4 |
| (h) | 212 | 10 | 5 | 212 | 13 | 3½ | 78.6 |
| (i) | 140 | 45 | 7.5 | 212 | 13 | 1 | 75.6 |
| (j) | 140 | 45 | 7.5 | 212 | 13 | 1¾ | 76.7 |
| (k) | 140 | 45 | 7.5 | 212 | 13 | 3½ | 76.7 |

Figure 3:
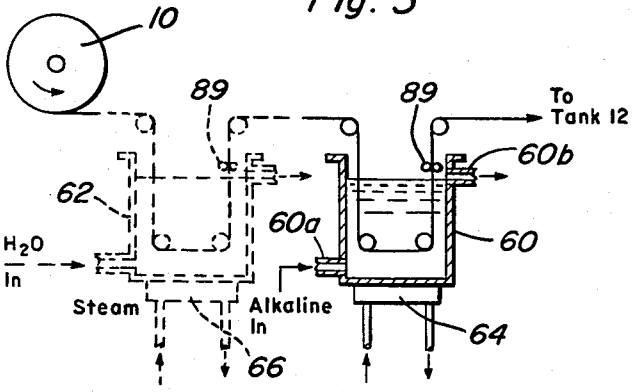
FIG. 3 illustrates the method of FIG. 1 utilizing an alkaline scour pretreatment prior to bleaching, with optional steps shown in phantom.

Referring now to FIG. 3, there is illustrated the practice of another form of bleaching pretreatment forming a part of this invention. In this embodiment, an aqueous alkaline scour bath having a pH maintained in the range 10 to 14 and a temperature in the range 160°–212° F. is employed preliminary to bleaching. It has been found that the use of a short alkaline scour pretreatment decreases the bleach time or increases bleached cloth whiteness levels for comparable bleach times; contributes to the flexibility, in appropriate cases, to use a single bleach bath without the need for bleach bath purification; reduces the amount of peroxide used to oxidize the colorants in the cloth; and avoids weakening the cloth by extended bleach baths.

In this alkaline scour embodiment, when employed, the cotton goods from roll 10 are immersed in a continuous fashion in the alkaline scour bath contained in tank 60 for a period of time ranging from 5 seconds to 3½ minutes, preferably from 1 to 3 minutes. The alkaline bath may be any strong base which can furnish the desired pH levels, for example, the alkali and alkaline earth hydroxides, preferably KOH or NaOH due to their ready availability and low cost. If desired, an optional water pre-dip, substantially as previously described, may be employed prior to alkaline scouring by passing the goods through tank 62 which contains water at a temperature from above room temperature to 212° F. The temperatures of the solutions in tanks 60 and 62 are maintained within the desired ranges by heaters 64 and 66, which may be steam operated heat exchangers. As with the bleach baths, the alkaline solution and water employed may be selected to be of the purity most appropriate for the overall process being conducted. Nevertheless, it is preferred in accordance with the present invention that all of the solutions be substantially free of heavy metal ions. It is further desired, although not of primary importance to the invention, that the portion of tanks 60 and 62 in contact with the solutions therein be non-metallic and the solutions be maintained out of contact with all metals while the goods are immersed therein. In one preferred embodiment, the alkaline pre-bath has a pH in the range 11.8 to 13.5, a temperature of 185°–212° F. and a time of immersion of 1 to 3 minutes. It has been found that a useful base white can be achieved following this preferred alkaline scour by immersing the goods in a hydrogen peroxide bleach solution for only about 1 minute.

On economic balance, use of a even a brief alkaline scour renders the bleaching process more expensive in terms of initial equipment costs than it would be if scouring, desizing and bleaching were accomplished simultaneously, since the alkaline scour process embodiment requires an additional hydroxide bath, associated monitoring equipment, and the like. On the other hand, the over-all process is rendered far more economical and the extra initial equipment costs are rapidly amortized by use of the relatively short alkaline pre-bath since bleaching time is reduced, the burden of removing colorants from the cloth falls primarily upon the pre-bath and not upon the bleach solution, and, therefore, any continuing need for purifying the bleach solution is eliminated with an attendant savings in energy and chemical costs.

Notwithstanding that the length of time the goods are immersed in the scour bath is short, such a bath is so efficient in removing contaminants that it yellows very rapidly and pollution control may be accomplished by intermittent or continuous recycling, replenishing and purifying the alkaline scour bath to remove the contaminants therefrom, while only filtering and replenishing the bleach bath. This accounts for a large savings in energy and a particularly large savings in the cost of peroxide chemicals.

In one optional form of the alkaline scour bath, the bath includes bleach solution therein, for example a high pH hydrogen peroxide solution. In this manner, scouring is accompanied by oxidation and a very large proportion of the contaminants in the cloth are removed. Thus, the duration of the final bleach bath may be reduced to a comparatively short period of time and very little recycling and replenishing thereof is necessary. For example, in one continuous process, the scour bath may contain 1 to 10% by volume hydrogen peroxide at a temperature in the range 170°–212° F. and a pH of 10.75 to 14. Immersion in this bath for a period of 10 seconds to 2 minutes, preferably about 30 seconds, at pH 13.25 and 212° F. in a 10% peroxide bath, followed by an optional rinse in water substantially free of heavy metal ions, and then followed by a 45 second to 3 minute bleach in 10 to 50% by volume hydrogen peroxide solution at 170°–212° F. produces outstanding base whiteness.

Figure 5:
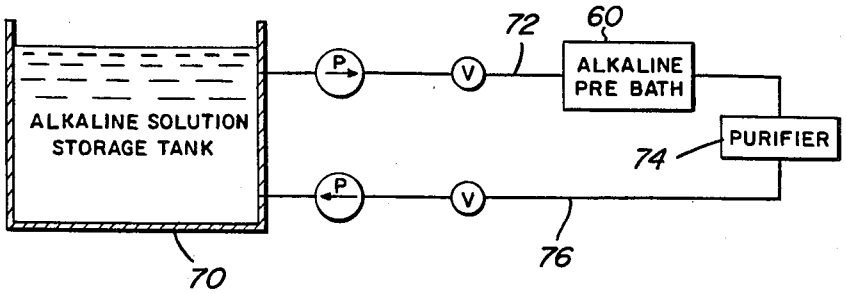
FIG. 5 is a schematic diagram in block form illustrating how the alkaline scour solution used in the methods of FIGS. 3 and 4 may be continuously or intermittently recycled.

It is, of course, quite surprising in view of the prior art's requirement for extensive and prolonged scouring or intensive scouring plus steaming that scouring and desizing can be accomplished to such a substantial extent in about 1 minute followed by complete bleaching in times as short as about 1 minute. Particularly advantageous is that solution purification can be limited to the scour solution while bleach solution treatment can be accomplished largely by filtration and replenishment. As a result, the energy and chemical costs of such a system are less than any heretofore suggested. In this connection, reference is made to FIG. 5 where a system for recycling, purifying and replenishing the alkaline scour bath is shown. The alkaline scour solution is stored in tank 70 to which additional solution may be added to make up for evaporation and depletion, to maintain alkaline scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the scour solution in the system. The storage tank outlet line 72 is connected to the inlet 60*a* of tank 60 (FIG. 3). The outlet 60*b* of tank 60 is piped through purifier 74 (which may include mechanical filter means, as necessary), wherein dissolved and suspended solids, oils and the like impurities are removed and then through storage tank return line 76 to tank 70. It is believed that when the alkaline scour bath is continuously recycled, replenished and purified considerable scouring can be achieved in very short periods of time with the result that the bleach times necessary to achieve predetermined whiteness levels are thereby much reduced. By removing the yellow coloring matter formed in the alkaline scour bath as fast as it is formed, a synergistic effect is noted which decreases the scour time by an unaccountably large factor and, at the same time, considerably decreases the bleaching time.

The following Examples are illustrative of the present process employing an alkaline scour pretreatment of goods prior to bleaching.

EXAMPLE II

A number of aqueous hydrogen peroxide bleach solutions having various pH levels, all of which were substantially free of heavy metal ions, were prepared at concentration levels ranging from 0.75 to 15% by volume hydrogen peroxide. The same cotton greige goods were subjected to an alkaline scour and then immersed in each bleach solution in a glass container, rinsed and dried and base white readings made thereon. The following Table II summarizes the scour and bleach conditions and the resulting base whites.

TABLE II

| | ALKALINE SCOUR | | | BLEACH | | | | |
|---|---|---|---|---|---|---|---|---|
| | pH | Temp. (°F.) | Time (Min.) | $H_2O_2$ % by Vol. | Temp. (°F.) | pH | Time (Min.) | BASE WHITE |
| (a) | 13.5 | 212 | ½ | .75 | 212 | 13 | 1 | 67 |
| (b) | 13.5 | 212 | ½ | .75 | 212 | 13 | 1¾ | 69.5 |
| (c) | 13.5 | 212 | ½ | .75 | 212 | 13 | 3½ | 74 |
| (d) | 13 | 212 | 1 | 3 | 185 | 12 | 1 | 67 |
| (e) | 13 | 212 | 1 | 3 | 185 | 12 | 3½ | 75 |
| (f) | 13 | 212 | 1 | 3 | 212 | 12 | 3½ | 77.2 |
| (g) | 13.8 | 212 | 1 | 5.1 | 212 | 13.3 | 1 | 74.1 |
| (h) | 13.8 | 212 | 1 | 5.1 | 212 | 13.3 | 1¾ | 76.1 |
| (i) | 13.8 | 212 | 1 | 5.1 | 212 | 13.3 | 2½ | 76.4 |
| (j) | 13.8 | 212 | 1 | 5.1 | 212 | 13.3 | 3½ | 77.7 |
| (k) | 14 | 212 | ½ | 15 | 212 | 7.1 | 3½ | 79 |

EXAMPLE III

A sample of cotton goods was subjected to a water dip pretreatment in 140° F. heavy metal ion free water for 45 seconds, and then bleached in a 3% by volume aqueous hydrogen peroxide solution at pH 11.8 and 185° F. for 3½ minutes. From Table I(c), it can be seen that the resulting cloth exhibited a base whiteness of 73.4.

By comparison with the results of Table II(e), comparable goods which received substantially the same bleaching treatment but which were pretreated in an alkaline scour bath at pH 13 and 212° F. for 1 minute instead of in a water dip exhibited a base whiteness of 75. This confirms the enhanced whiteness attainable with brief alkaline scour pretreatments.

EXAMPLE IV

A number of aqueous hydrogen peroxide bleach solutions having various pH levels, all of which were substantially free of heavy metal ions, were prepared. Cotton greige goods samples were immersed in an alkaline scour solution at pH 14 and 212° F. for the times indicated in Table III after which the samples were bleached, rinsed and dried and base white readings made thereon. The following Table III summarizes the scour and bleach conditions and the resulting base whites.

TABLE III

| | SCOUR | BLEACH | | | | |
|---|---|---|---|---|---|---|
| | Time (Min.) | $H_2O_2$(% by Vol) | Temp. (°F.) | pH | Time (Min.) | BASE WHITE |
| (a) | 3½ | 7.5 | 212 | 6.9 | 3½ | 79.6 |
| (b) | 3½ | 7.5 | 212 | 6.9 | 7 | 80 |
| (c) | 2 | 15 | 212 | 6.9 | 3½ | 78.5 |
| (d) | 1 | 30 | 167 | 3 | 7 | 72.5 |
| (e) | 1 | 30 | 212 | 3 | 3½ | 75.4 |

In order to compare the effectiveness of no-pretreatment bleaching with a bleaching process which includes an alkaline scour pretreatment prior to bleaching the following tests were carried out.

EXAMPLE V

An aqueous hydrogen peroxide solution substantially free of heavy metal ions was prepared containing 10% by volume hydrogen peroxide at pH 6.9 and 212° F. A sample of cotton greige goods bleached therein for 3½ minutes exhibited a base whiteness of 74.

Be comparison with the results of Table III(a) which includes a 3½ minute alkaline scour at 212° F. and pH 14, it is apparent that the base whiteness was increased to 79.6 using the alkaline scour notwithstanding that the bleach solution contained 25% less hydrogen peroxide.

EXAMPLE VI

An aqueous hydrogen peroxide solution substantially free of heavy metal ions was prepared containing 10% by volume hydrogen peroxide at pH 6.9 and 212° F. A sample of cotton greige goods bleached therein for 7 minutes exhibited a base whiteness of 77.5.

By comparison with the results of Table III(b) which includes a 3½ minute alkaline scour at 212° F. and pH 14, it is apparent that the base whiteness was increased to 80 using the alkaline scour notwithstanding that the bleach solution contained 25% less hydrogen peroxide.

EXAMPLE VII

The no-pretreatment bleaching example of Example VI evidencing a base whiteness of 77.5 was compared with the base whiteness achieved using the alkaline scour plus bleach process of Table III(a) evidencing a base whiteness of 79.6. Both processes employed a total treatment time of 7 minutes although the scour-bleach process used only 3½ minutes for bleaching and the bleach solution contained 25% less hydrogen peroxide.

Nevertheless, it is apparent that the scour-bleach process produced a superior result, showing the benefits to be achieved using an alkaline scour prior to bleaching.

EXAMPLE VIII

An aqueous hydrogen peroxide solution substantially free of heavy metal ions was prepared containing 15% by volume hydrogen peroxide at pH 6.9 and 212° F. A sample of cotton greige goods bleached therein for 5½ minutes exhibited a good base whiteness. However, when the 5½ minute treatment time was broken down into a 2 minute alkaline scour at pH 14 and 212° F. followed by a 3½ minute bleach in a solution containing 15% by volume hydrogen peroxide at pH 6.9 and 212° F., the base whiteness and overall result achieved was much superior than where the bleach solution was used without the alkaline scour.

Figure 4:
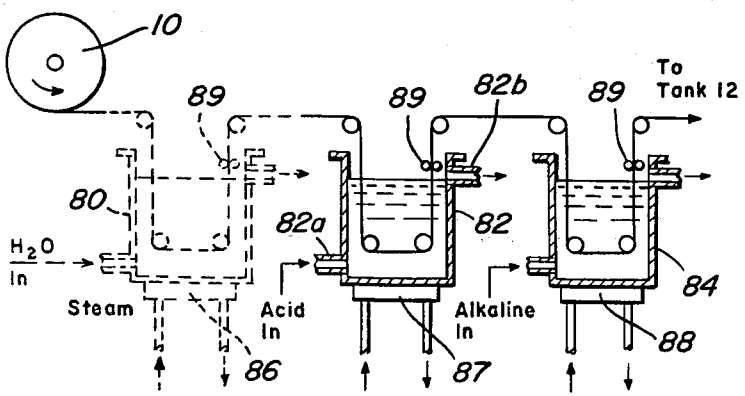
FIG. 4 illustrates the method of FIG. 1 utilizing separate and sequential alkaline and acid scour pretreatments prior to bleaching, with optional steps shown in phantom.

Still another embodiment employing a bleaching pretreatment of the present invention is shown in FIG. 4 wherein an acid scour bath is employed preliminary to the alkaline scour bath of FIG. 3 to constitute a combined acid-alkaline sequential bath pretreatment for producing an instantaneous cracking of the sizing and chemical coatings of the fibers in the cotton greige goods. Alternatively, but not illustrated, the alkaline scour bath of FIG. 4 can be employed preliminary to the acid scour bath. The effect, irrespective of the bath sequence, is believed akin to a type of explosive hysteresis wherein the pH cycling in the scour baths causes the fibers to swell and contract and the oils, chemicals and coatings to be solubilized rather rapidly by the alternate contraction and swelling. In this manner, the alternating acid and base baths cause the contaminants on the goods to be explosively removed from the fibers. As can be seen from FIG. 4, the cotton goods may first be moved from roll 10 to an optional water dip in tank 80 (as has been previously described) at a temperature from above room temperature to 212° F. Following the water dip, if it is used, or directly from roll 10, the cotton goods are immersed in tank 82 in an acid solution having a pH in the range up to about 3.0, most usually 0.5 to 3.0, and desirably less than about pH 1, at a temperature in the range 45°–212° F. for a very brief time up to about 10 seconds. Immediately upon exiting the acid bath, the goods are immersed in tank 84 containing an alkaline scour bath as has been previously herein described. The temperatures of the solutions in tanks 80, 82 and 84 are maintained within the desired ranges by heaters 86, 87, 88 which may be steam operated heat exchangers. Following the alkaline scour bath the goods may be passed through an optional dip in water in tank 12 after which they are subjected to hydrogen peroxide bleaching. The bleach solution which is employed may be a conventional hydrogen peroxide solution, e.g. 0.25 to 70% by volume peroxide, pH 2–14 and temperatures in the range 160°–212° F. However, the great advantage of this embodiment of the process depicted in FIG. 4 is that bleaching becomes extraordinarily rapid and extraordinarily high whitenesses are achieved with practically no contamination whatever of the peroxide bleach bath. Thus it is only necessary to minimally recycle, filter and replenish the hydrogen peroxide bleach bath and purification efforts can be limited to the acid and alkaline scour baths.

Figure 6:
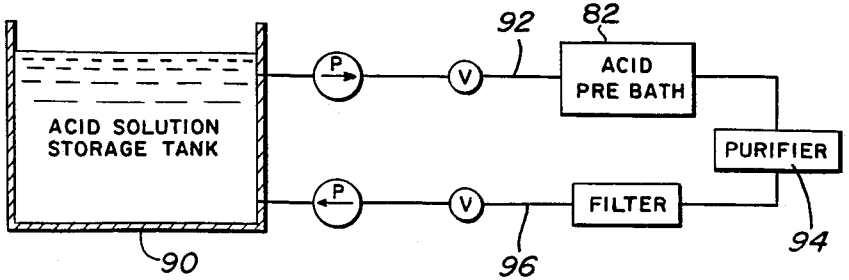
FIG. 6 is a schematic diagram in block form illustrating how the acid scour solution used in the method of FIG. 4 may be continuously or intermittently recycled.

Thus, with reference to FIG. 6, there is shown a typical system which can be used to intermittently or continuously recycle, purify and replenish the acid scour bath. The acid scour solution is stored in tank 90 to which additional solution may be added to make up for evaporation and depletion, to maintain acid scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the acid scour solution in the system. The storage tank outlet line 92 is connected to the inlet 82*a* of tank 82. The outlet 82*b* of tank 82 is piped through purifier 94, which may include mechanical filter means, as necessary, and then through storage tank return line 96 to tank 90. The system shown in FIG. 5 would, of course, be used to recycle, replenish, and purify the alkaline scour solution from tank 84.

In moving the goods from bath to bath, in any of the processes described in connection with FIGS. 1, 3 or 4, it is desirable to preclude carry-over of solutions from tank to tank. The reason is obviously to prevent the solution in each succeeding tank from becoming contaminated by the solution from the preceding tank. This is particularly so because the concentration, temperature and pH of each solution, as has hereinbefore been noted, influences the efficiency of that solution for its particular task. Thus, utilizing FIG. 4 for descriptive purposes, it would be extremely undesireable to carry-over the low pH acid solution from tank 82 into the high pH alkaline solution in tank 84. Likewise, carry-over of high pH alkaline solution from tank 84 into neutral water-dip solution in tank 12 would adversely affect the pH of the solution in tank 12. For these reasons it is recommended that the goods pass through squeeze rollers 89 as they emerge from each solution, whereby the solution is forced from the goods and drips back into each tank. For obvious reasons, it is most desirable to minimize solution. Although no hard and fast rules in such matters are appropriate, should be minimized so that the cloth remains damp, but of solution quantities exceeding 25% of the weight of the fabric being processed is believed excessive and will likely have an observable adverse affect upon solution identity and usefulness.

Another problem associated with moving goods from tank to tank is that the goods tend to lose heat and reduce in temperature between the time they emerge from one solution and enter the next solution. Particularly where there is a relatively small solution to fabric ratio in the tank, the goods cause the solution in the tank to drop in temperature from the desired temperature, with attendant loss in operating efficiency. In part, optional water-dip baths in tanks 12, 66 and 86 serve to raise the fabric temperature and thereby to somewhat alleviate this problem. A better, albeit more costly solution, is to provide heated rollers (not shown) at the inlet to each tank and to cause the fabric to pass between these rollers prior to entering the solution in the tank. If the rollers are heated by steam, for example, their temperature can be controlled to correspond the temperature of the fabric to that of the solution it is about to enter.

There is, of course, an additional cost factor incident to employing the acid bath. However, the surprising efficiency of the combined acid-alkaline scour baths as a bleaching pretreatment in removing contaminants markedly reduces bleach time and bleach chemical waste, and the attendant savings more than offsets the additional costs incident to the process. In addition, the whitest bleached cloths result from using the acid-alkaline scour. Moreover, total acid-alkaline scour time is generally less than the scour time if only the alkaline bath is used. For example, a 10 second acid-10 second alkaline scour can achieve results comparable to a 1 minute alkaline scour alone. Furthermore, bleach times experienced using an acid-alkaline pretreatment are reduced by about 25% compared to using the alkaline scour pretreatment process embodiment alone, with total acid-alkaline pretreatment and bleach times typically in the range 1 minute to 1½ minutes where high concentration, high acid pH and high temperature bleach solutions are used. It is, of course, appreciated, as already noted, that the order of the acid-alkaline scour baths can be reversed with no observable change in beneficial results.

It is preferred that the acid scour pretreatment bath have a pH in the range less than 3 and preferably 0.5 to 1, a temperature in the range 45° to 120° F. and more preferably 50°–85° F., and a total immersion time of 1 to 10 seconds, preferably 1 to 5 seconds and usefully 0.5 to 3 seconds. Any strong acid can be used which can achieve these pH levels.

The following Examples are illustrative of the process employing separate and sequential acid and alkaline scour baths prior to bleaching.

EXAMPLE IX

A sample of cotton greige goods was immersed in a pH 14 alkaline scour bath at 212° F. for 1 minute followed immediately by a pH 0.65 acid scour bath at 68° F. for 5 seconds. The scoured goods were immersed in a 30% by volume aqueous hydrogen peroxide solution at pH 3 and 212° F. for 1 minute. All solutions and baths were substantially free of heavy metal ions. The resulting goods evidenced a base whiteness of 80.2 for a total treatment time of only 2 minutes and 5 seconds.

By comparison, the same goods were treated under substantially the same conditions except that the acid bath was omitted and bleaching was continued for 3½ minutes as set forth in Table III(e). Notwithstanding that the total treatment time was 4½ minutes, more than twice as long, the base whiteness of the goods was only 75.4, indicating the great value of a brief acid scour.

EXAMPLE X

Using glass lined containers and all solution ingredients substantially free of heavy metal ions, and continuously purifying and replenishing the scour baths and filtering and replenishing the bleach baths, four samples of cotton greige goods were immersed sequentially in the following solutions under the indicated conditions:

(1) Tap water at 212° F. for 10 seconds;

(2) HCl solution at pH 0.65 at 68° F. for 2 seconds;

(3) NaOH solution at pH 14 and 212° F. for 10 seconds;

(4) 3% by volume hydrogen peroxide bleach solution at pH 14 and 212° F. for times of (a) 45 seconds, (b) 1 minute, (c) 1¾ minutes and (d) 3½ minutes.

The following base whites were measured:

(a) 70.6 at 45 seconds;

(b) 73 at 1 minute;

(c) 75.9 at 1¾ minutes; and (d) 78.5 at 3½ minutes.

It is noteworthy that the total pre-treatment time was only 22 seconds and that base whites in excess of 70 were achieved with as little as 45 seconds of bleach, a total of only 67 seconds of goods treatment time.

EXAMPLE XI

Using glass lined containers and all solution ingredients substantially free of heavy metal ions, and continuously purifying and replenishing the scour baths and filtering and replenishing the bleach baths, cotton greige goods were immersed sequentially in the following solutions under the indicated conditions:

(1) NaOH solution at pH 14 and 212° F. for 80 seconds;

(2) HCl solution at pH 0.9 and 68° F. for 5 seconds;

(3) 30% by volume hydrogen peroxide bleach solution at pH 7.1 and 212° F. for 3½ minutes.

The resulting bleached cloth had a base white of 80.

EXAMPLE XII

Two samples of cotton goods were bleached in a solution comprising 12.5% by volume hydrogen peroxide and 0.5% by volume sodium silicate at pH 7.25 and 212° F. for 3½ minutes. One of the samples was bleached in a bath containing a commercially available fluorescent whitener therein in a quantity of about 0.5 to 1% by weight of the cotton goods. The base whiteness readings of the bleached goods were:

| | |
|---|---|
| No whitener sample | 71 |
| Whitener sample | 72 |

Samples of the same cotton goods were pretreated in an alkaline scour bath at pH 14 and 212° F. for 2½ minutes, followed by an acid scour bath at pH 0.75 and 75° F. for 10 seconds. The pretreated goods were then bleached without whitener in the same composition bleach bath as set forth above for periods of 1.5, 2.5, 3.5, 5 and 7 minutes, rinsed, dried and whiteness readings made as follows:

| BLEACH TIME (minutes) | BASE WHITENESS |
|---|---|
| 1.5 | 74 |
| 2.5 | 75.5 |
| 3.5 | 78.5 |
| 5 | 79.5 |
| 7 | 80+ |

It is evident from the direct comparison available at 3½ minute bleach time, that the acid-alkaline pretreatment of the invention significantly enhances the base whiteness of the bleached cloth. Indeed, even when the bleaching time was reduced to 1.5 minutes, the base whiteness of the level of the pretreated cloth was significantly improved.

EXAMPLE XIII

A number of aqueous hydrogen peroxide bleach solutions having various pH levels and bleach concentrations were prepared and used to bleach cotton goods which had been pretreated as follows:

(a) immersed for 2—2½ minutes in pH 13.5 NaOH at 212° F.; and (b) immersed for 1–10 seconds in pH 0.75 HCl at 75° F.

Following bleaching, each sample was rinsed and dried and base-white readings made and recorded for each bleach bath as follows:

TABLE IV

| | $H_2O_2$ % by Vol. | Bleaching Additives | Temp (°F.) | pH | Time (Min) | BASE WHITE |
|---|---|---|---|---|---|---|
| (a) | 0.5 | whitener | 212 | 10.5 | 7 | 72 |
| (b) | 3 | whitener | 212 | 8.0 | 7 | 75 |
| (c) | 15 | silicate, whitener | 160 | 10.5 | 7 | 72.5 |
| (d) | 23 | silicate, whitener | 165 | 7.5 | 7 | 74 |
| (e) | 30 | whitener | 200 | 6.8 | 5 | 78.5 |

The foregoing evidences that use of the acid-alkaline pretreatment baths of the present invention will permit short term bleaching to commercially acceptable whiteness levels in a variety of bleach solution compositions and under varied bleaching conditions.

EXAMPLE XIV

Two samples of cotton goods were subjected to the same bleach solutions under identical bleaching conditions. Only one of the samples was pretreated as set forth below prior to bleaching. The following tabulations summarize the pretreating and bleaching conditions and the base white levels of the resulting bleached goods and confirm that the acid alkaline pretreatment of the present invention is extraordinarily effective in enhancing base whiteness levels or reducing bleaching times.

PRETREATMENT CONDITIONS (One Sample)

(a) 2 minute hot water rinse;
(b) 2½ minute NaOH scour at pH 13.5 and 212° F.;
(c) 10 second acid scour in pH 0.75 HCl at 70° F.

BLEACHING CONDITIONS (Both Samples)

30% by volume hydrogen peroxide, solution containing 0.5% by volume sodium silicate and 0.25% whitener based on the weight of the fabric;

| | |
|---|---|
| pH | 3.4; |
| Temp. | 207–212° F.; |
| Bleach Time | 7 minutes |

BASE WHITES

| | |
|---|---|
| Bleached Sample | 73 |
| Pretreated/Bleached Sample | 80 |

EXAMPLE XV

Two samples of cotton goods were subjected to the same bleach solutions under identical bleaching conditions. Only one of the samples was pretreated as set forth below prior to bleaching. The following tabulations summarize the pretreating and bleaching conditions and the base white levels of the resulting bleached goods and confirm that the acid alkaline pretreatment of the present invention is extraordinarily effective in enhancing base whiteness levels or reducing bleaching times.

PRETREATMENT CONDITIONS (One Sample)

(a) 2 minute hot water rinse
(b) 2½ minute NaOH scour at pH 13.5 and 212° F.
(c) 10 second acid scour in pH 0.65 HCl at 70° F.

BLEACHING CONDITIONS (Both Samples)

0.35% by volume hydrogen peroxide solution containing 0.65% by weight citric acid;

| | |
|---|---|
| pH | 3.5 |
| Temp. | 212° F. |

In this instance bleaching was continued for each sample until it achieved a base white level of 72 and the bleaching time to reach this level was recorded for each sample as follows:

| | |
|---|---|
| Bleached Sample | 35 minutes |
| Pretreated/Bleached/Sample | 13 minutes |

EXAMPLE XVI

Three samples, A, B and C, of cotton goods were subjected to the same bleach solutions under identical bleaching conditions. One of the samples, A, was not pretreated. One of the samples, B, was pretreated in a tap water dip for about 2 minutes. One of the samples, C, was pretreated in a tap water dip for about 2 minutes, followed by a 2½ minute alkaline scour in pH 13.5 NaOH at 212° F. followed by a 10 second acid scour in pH 0.65 HCl at 75° F. The following tabulations summarize the bleaching conditions and the base white levels of the resulting bleached goods, and confirm that the intensity of the pretreatment has a marked and notable effect upon the base whiteness levels achieved.

BLEACHING CONDITIONS (All Samples)

12.5% by volume hydrogen peroxide solution containing 1% by volume sodium silicate and 0.5–1% whitener based on the weight of the fabric;

| | |
|---|---|
| pH | 7.3 |
| Temp. | 212° F. |
| Bleach Time | 5 minutes |

BASE WHITES

| | | |
|---|---|---|
| Sample A | Bleached only | 72.5 |
| Sample B | Water dip pretreated/Bleached | 73.5 |
| Sample C | Acid-Alkaline pretreated/ Bleached | 79.5 |

EXAMPLE XVII

Three samples, C, D, E, of cotton-nylon 50—50 blend greige goods were subjected to the same bleach solutions under identical bleaching conditions. Samples C and D were not pretreated. Sample E was pretreated in a hot water rinse followed by a 2 minute alkaline scour in pH 14 NaOH at 212° F. followed by a 10 second acid scour in pH 0.65 HCl at 75° F. The following tabulations summarize the bleaching conditions and the base white levels of the resulting bleached goods, and confirm that the intensity of pretreatment has a marked and notable effect upon the base whiteness levels achieved.

BLEACHING CONDITIONS (All Samples)

12.5% by volume hydrogen peroxide solution with ½–1% whitener based on the fabric weight included in the solution for samples D and E only

| | |
|---|---|
| pH | 7.35 |
| Temp. | 212° F. |
| Bleach Time | 3½ minutes |

BASE WHITES

| | | |
|---|---|---|
| Sample C | Bleached (no whitener) | 69 |
| Sample D | Bleached (whitener) | 70 |
| Sample E | Pretreated/Bleached (Whitener) | 75 |

EXAMPLE XVIII

Three samples, F, G and H, of cotton goods were subjected to the same bleach solutions under identical bleaching conditions. One of the samples, F, was not pretreated. One of the samples, G, was pretreated in a tap water dip of about 15 seconds. One of the samples, H, was pretreated in a tap water dip at 140°–212° F. for about 2 minutes, followed by a 2½ minute alkaline scour in pH 14 NaOH at 212° F. followed by a 10 second acid scour in pH 0.65 HCl at 75° F. The following tabulations summarize the bleaching conditions and the base white levels of the resulting bleached goods, and confirm that the intensity of pretreatment has a marked and notable effect upon the base whiteness levels achieved.

BLEACHING CONDITIONS (All Samples)

3% by volume hydrogen peroxide solution containing no additives other than pH adjustors.

| | |
|---|---|
| pH | 10.5 |
| Temp. | 212° F. |
| Bleach Time | 3½ minutes |

BASE WHITES

| | | |
|---|---|---|
| Sample F | Bleached only | 74 |
| Sample G | Water dip pretreated/Bleached | 74.5 |
| Sample H | Acid-Alkaline pretreated/ Bleached | 77 |

Although it will be appreciated that the present process is effective by pretreating cotton, cotton blend and other selected cellulosic materials preliminary to bleaching, irrespective of the bleaching solution employed, it has been found that the pretreatment parameters, whether the pretreatment is water dip, and/or alkaline pre-scour and/or alkaline and acid pre-scours, are selected based to a large extent on the result desired. Moreover, since every cloth is different no hard and fast rules can be cited which will apply in all cases. However, it is apparent from experience that some bleach solutions are easier to use or more effective than others—e.g., considering hydrogen peroxide bleaching, 70% by volume hydrogen peroxide is difficult to work with and even 30%, 50% and 70% by volume baths at about 212° F. and high pH can be extremely active. Therefore, when working with these bleach solutions at such high temperatures, pH and treatment times must be carefully controlled to avoid weakening the bleached goods to the point that they lose their tensile strength. If the bleach solution becomes too active, water jacketing of the bleach tank may be desirable. Moreover, care should be exercised in selecting the most beneficial bleaching and pretreatment parameters consistent with producing a bleached cloth product suitable for the ultimately desired purpose. For example, when lower concentrations of peroxide are used or where higher concentrations are used at low temperatures, there is a significant decrease in bleaching time as a function of the intensity of the scour treatments. The acid plus alkaline scour treatment prior to bleaching is the most effective pre-treatment when low pH bleach systems are used or where maximum base whiteness is the primary criteria.

By and large the most effective bleaching solution for use in conjunction with the pretreatments herein described in an aqueous hydrogen peroxide solution containing pH adjustors to alter solution pH to the desired range for bleaching the particular goods being processed. It is, of course, appreciated that there are a number of variables in selecting appropriate hydrogen peroxide bleaching conditions, e.g., bleach time, hydrogen peroxide concentration, pH of bleach solution and temperature of bleach solution. Surprisingly, it has been found that satisfactory whiteness levels can be achieved using concentrations of hydrogen peroxide in the very broad range from 0.25 to 70% by volume; bleach solution pH in the range from 2 to 14; bleach solution temperatures in the range 160° to 212° F.; and bleach times up to 30 minutes. It is particularly desirable to reduce overall goods treatment times, e.g., by using the pretreatments of the present invention, and therefore it is desirable to accomplish the bleaching step in short periods of time as well, preferably not exceeding seven minutes, and most desirably in less than about 3½ minutes.

There are a number of hydrogen peroxide embodiments of the bleach solution compositions and parameters which are particularly suitable for accomplishing this. For example, the pH can be maintained above about pH 10, temperatures in the range about 160 degrees to 212 degrees F. and hydrogen peroxide concentrations of 0.5 to 15% by volume. Of course, it will be appreciated that the rapid bleaching achieved with this bleaching configuration is at the expense of increased pH and increased temperatures and that such a process is relatively costly in its energy requirements, in its chemical costs notwithstanding the relatively low peroxide concentrations since the high pH depletes the peroxide rapidly, and in the need to reduce solution pH, as by ion exchange, prior to dumping spent bleaching solutions. In another typical rapid bleach hydrogen peroxide solution configuration the pH is lowered to the range 7 to 10. At these low pH's, and at temperatures of about 160° to 212° F., the peroxide concentration may advantageously be maintained in the range 1 to 50% by volume. This configuration is also relatively energy expensive due to the high temperatures employed but effects some chemical expense savings due to the relatively low pH and the attendant reduced rate of peroxide depletion. More importantly, the low pH levels substantially reduce the problems and expense incident to dumping spent bleaching solutions and to some extent reduce the deleterious bleach solution fumes common to high alkaline solutions.

In still another useful bleaching embodiment, rapid peroxide bleaching is accomplished by maintaining solution pH in the range 6 to 7 with temperatures in the range 160° to 212° F. and at hydrogen peroxide concentrations of 10 to 50% by volume. Of course, in this embodiment, such rapid bleaching is achieved at the expense of increased peroxide concentration and increased temperature. Thus, this configuration is relatively costly in its energy and chemical requirements. Probably the greatest advantage of this embodiment configuration, though, is that it permits bleaching to be accomplished at or near neutral pH, thus eliminating the need for expensive treatment of spent bleach solutions prior to dumping.

One additional highly desirable rapid form of hydrogen peroxide bleaching operates in the pH range 2 to 3 at temperatures of 195° F. to 212° F. and at hydrogen peroxide concentrations of 30 to 70% by volume. Under these conditions, commercially acceptable whitenesses, as are defined herein, are attainable in less than about 7 minutes. However, the real advantage of this embodiment is that it permits the use of stock solutions with no need for alkaline additions to adjust pH. Thus, foaming problems due to the reaction between alkali and hydrogen peroxide are avoided and the bleach solution is extremely stable. Moreover, bleaching solution depletion due to reaction with alkali is avoided with an attendant savings in chemical costs.

In the preferred practice of hydrogen peroxide bleaching, as is disclosed in detail in U.S. Pat. Nos. 4,060,385 and 4,060,386; the bleaching solution, as well as all pretreatment solutions, should be substantially free of heavy metal ions. This is because the presence of heavy metal ions has been found to cause peroxide solution depletion at an uneconomically acceptable rate and to discolor or contribute to the discoloration of goods bleached in solutions which are not substantially free therefrom.

The following methods may be used to provide hydrogen peroxide which is substantially free of heavy metal ions.

Hydrogen peroxide can be made in a pure form essentially free of heavy metal ions by oxidizing in the liquid phase isopropyl alcohol or another secondary alcohol having 3 to 6 carbon atoms with oxygen or a gas containing oxygen at a temperature between 80° C. and 160° C. under a pressure which is at least sufficient to allow the alcohol to remain in the liquid phase as described in U.S. Pat. No. 3,592,776, Fletcher et al, issued July 13, 1971. Since in this method the only catalyst used is hydrogen peroxide itself or a nonmetalic free-radical producer such as azobisisobutyronitrile, the reaction starting materials are essentially free of heavy metal ions. Thus the hydrogen peroxide produced can be easily purified and concentrated by distillation with reduced danger of explosion.

Alternatively, suitable hydrogen peroxide may be purchased commercially as ACS reagent grade 30% designated 0004 HP 30 by Shell Oil Co. The following table gives the approximate analysis of this hydrogen peroxide:

| TABLE | BAKER #2186 |
|---|---|
| Assay ($H_2O_2$) | 31.4% |
| Iron (Fe) | 0.00002% |

-continued

| TABLE | BAKER #2186 |
|---|---|
| Heavy Metals (as Pb) | 0.00003% |
| Ammonium ($NH_4$) | 0.0005% |
| Sulfate ($SO_4$) | 0.0002% |
| Phosphate ($PO_4$) | 0.00007% |
| Nitrate ($NO_3$) | 0.00007% |
| Chloride (Cl) | 0.0001% |
| Free Acid (as $H_2SO_4$) | 0.0004% |
| Residue after evaporation | 0.0006% |

In the event that organic impurities boiling at a higher temperature than $H_2O_2$ are present, they can be removed by counter-current, continuous, liquid-liquid extraction methods as described in U.S. Pat. No. Re. 25,114, original U.S. Pat. No. 2,949,343 by Hood et al.

Another hydrogen peroxide which can be used is also commercially available from the Shell Oil Co. as their 30% electronic grade which has the following analysis: Heavy Metal (as Pb)—0.001%; Iron (as Fe)—0.00005%; Silicon—0.00005%; Nickel—0.000002%; Chromium—0.000002%.

The aforementioned Fletcher patent uses a method of reacting the $H_2O_2$ with urea to form a $H_2O_2$ urea adduct that can be easily precipitated from the reaction mixture and reacted with an extracting solvent such as acetone that decomposes the adduct and precipitates the urea. This leads to a solution of $H_2O_2$ in acetone that is extracted with more acetone and finally the acetone is removed by distillation.

The sodium hydroxide or the alkaline or other pH adjusting additives used to alter peroxide pH should also preferably be substantially free of heavy metal ions. For example, ACS, Reagent grade NaOH; Fisher Scientific Catalog #S-318 is suitable. One form of this certified ACS NaOH contains 0.0003% iron.

Most commonly used hydrogen peroxide bleaching solutions employ various type additives to stablize, buffer, wet, chelate, accelerate, and the like, or to alter in some respect an attribute of the bleaching system. The present pretreatment methods are equally applicable and are effective with all of these bleaching additives. However, it should be appreciated that all of these additives, whether they be only buffers, chelating agents, wetting agents, stablizers or the like, whether they take specific forms such as silicates, phosphates, citrates, carbonates, bicarbonates, EDTA, zinc compounds, organic and inorganic stabilizers, antioxidants, borates and perborates, or many others too numerous to mention, have been found to be, in one respect or another, deleterious to the bleach bath or to the resulting bleached goods. They render the baths more highly ionic, more complex and difficult to control, and reduce or eliminate the effectiveness of fluorescent brightners. They also tend to weaken the cloth, and/or cause or contribute to its discoloration. They impose additional costs to replace bleach chemicals; to maintain bleach system pH, temperature and concentration; to control pollution problems which their use creates; and to control bleach bath foaming which they frequently cause. Moreover, considering the rapidity with which bleaching can now be accomplished, particularly when the pretreatments of the present invention are used, the prior salutary effects of these additives, e.g., to reduce rate of bleach bath depletion, have been rendered de minimis. In view of this, the most preferred hydrogen peroxide bleaching solutions are solutions which substantially exclude all components other than the aqueous hydrogen peroxide and necessary pH adjustors.

Although the present invention has been described with reference to the pretreatment and bleaching of cotton and cotton-blend goods, it will be appreciated that the same advantages can be obtained with selected other cellulosic materials. For example, pretreatment and bleaching of available commercial wood pulps has been found to be a typically suitable subject for bleaching. The particular pretreatment and bleaching parameters will vary from pulp type to type depending upon their chemical constituents and the predominance of ligneous and other impurities. Nevertheless, wood pulp, bagasse, straw and the like may all be effectively pretreated and bleached within the parameters outlined in accordance with the present invention.

EXAMPLE XIX

Light colored coniferous wood was formed into sawdust and pretreated in accordance with the present invention in preparation for subsequent bleaching in any commercially acceptable manner. Because the sawdust was particulate, it was handled during the process using strainers rather than the roller system illustrated herein and applicable to roll-type cotton goods. 30 grams of the sawdust was dispersed in 970 ml. tap water and the water boiled for 2 minutes at 212° F. The sawdust pulp was decanted in a strainer and maintained in 970 ml of a pH 13.5 NaOH scour bath at 212° F. for 2 minutes. The resulting sawdust pulp was again decanted in a strainer and the pulp and strainer dipped into an acid scour bath maintained at pH 0.60 HCl and 25° C. for 15 seconds.

This thus pretreated sawdust plup was thereafter subjected to a series of hot and cold tap water rinses prior to bleaching to remove excess acid solution and to prevent temperature shock when placed in hot bleach solution.

EXAMPLE XX

Sawdust pulp samples pretreated as set forth in Example XIX were bleached in the following bleach solutions for the indicated time periods with the result that base whiteness levels exceeding commercial acceptability were consistently achieved.

Bleach Composition A 2.1% by volume aqueous hydrogen peroxide at pH 8.5 and 212° F. for 12 minutes.

Bleach Composition B

30% by volume aqueous hydrogen peroxide at pH 3.5 and 212° F. for 15 minutes.

Bleach Composition C

15% by volume aqueous hydrogen peroxide at pH 6.9 and 205° F. for 15 minutes.

Bleach Composition D 1.0% by volume aqueous hydrogen peroxide at pH 13 and 205° F. for 15 minutes.

Bleach Composition E 12.5% by volume aqueous hydrogen peroxide at pH 12.5 and 200°-212° F. for 3.5 to 5 minutes.

Bleach Composition F 12.5% by volume aqueous hydrogen peroxide at pH 12.5 and 200°-212° F. for 3.5 to 5 minutes.

It is noteworthy that the pretreatment of Example XIX combined with the bleaching treatment of Example XX amount to a total pulp treatment time of only about 7.5 to 21 minutes, depending upon the parameters chosen. These treatment times compare most favorably with conventional pulp bleaching times which generally require at least 30 minutes hydrogen peroxide bleaching together with 5 minutes of acid anhydride bleaching, for example as disclosed in U.S. Pat. No. 3,193,445.

While the present invention has been described with respect to particular embodiments thereof, it will be understood by those skilled in the art that numerous modifications can be made without actually departing from the invention. Accordingly, all modifications and equivalents may be resorted to which fall within the scope of the invention as claimed.

I claim:

1. A process for treating cellulosic goods prior to bleaching for a time sufficient to achieve commercially acceptable whiteness in a chemical bleach solution comprising the step of: intimately contacting said goods with an alkaline scour solution for from 5 seconds to 3½ minutes prior to bleaching, said alkaline scour solution having a temperature in the range 160°-212° F. and a pH from 10 to 14.

2. A process as claimed in claim 1, wherein said goods are contacted with said alkaline scour solution for from 1 to 3 minutes.

3. A process, as claimed in claim 2, wherein said alkaline scour solution has a pH in the range 11.8 to 13.5.

4. A process, as claimed in claim 2, wherein said alkaline scour solution temperature is in the range 185° to 212° F.

5. A process, as claimed in claim 1, wherein said alkaline scour solution contains bleaching solution therein.

6. A process, as claimed in claim 5, wherein said bleaching solution is 1 to 10% by volume hydrogen peroxide.

7. A process, as claimed in claim 1, wherein a portion of said alkaline scour solution is cycled through a purification means to remove impurities therefrom while maintaining the volume, composition and pH of the said alkaline scour solution in contact with said goods substantially the same.

8. A process, as claimed in claim 1, wherein said intimate contact is achieved by immersing said goods in said scour solution.

9. A process, as claimed in claim 1, including the step of intimately contacting said goods with water for up to 3½ minutes prior to contacting said goods with said alkaline scour solution, said water having a temperature from just above ambient to 212° F.

10. A process, as claimed in claim 1, wherein said alkaline scour solution is substantially free of heavy metal ions.

11. A process, as claimed in claim 1, wherein said alkaline scour solution includes whitener enhancing agents therein.

12. A process, as claimed in claim 1, including the step of intimately contacting said goods with an acid solution for from 1 to 10 seconds prior to bleaching, said acid solution having a temperature in the range 45° to 212° F. and a pH less than about 3, one of said alkaline scour and acid solutions contacting said goods first and the other contacting said goods while said goods are at about the pH of the solution which first contacted said goods.

13. A process, as claimed in claim 12, wherein said acid solution pH is 0.5 to 1.

14. A process, as claimed in claim 12, wherein said acid solution temperature is in the range 45° to 100° F.

15. A process, as claimed in claim 12, wherein said goods are contacted with said acid solution for from 1 to 5 seconds.

16. A process, as claimed in claim 12, wherein a portion of said acid solution is cycled through a purification means to remove impurities therefrom while maintaining the volume, composition and pH of said acid solution in contact with said goods substantially the same.

17. A process, as claimed in claim 12, wherein said intimate contact is achieved by immersing said goods in said scour solution.

18. A process, as claimed in claim 12, wherein said goods are contacted with said acid solution prior to being contacted with said alkaline scour solution.

19. A process, as claimed in claim 18, wherein said acid solution lowers the pH of said goods to a pH less than 3 and said goods are immersed in said alkaline solution while at said pH less than 3.

20. A process, as claimed in claim 12, wherein said goods are contacted with said alkaline scour solution prior to being contacted with said acid solution.

21. A process, as claimed in claim 20, wherein said alkaline scour solution raises the pH of said goods to a pH in the range 10 to 14 and said goods are immersed in said acid solution while at said pH 10 to 14.

22. A process, as claimed in claim 12, wherein said acid solution is substantially free of heavy metal ions.

23. A process, as claimed in claim 12, including the step of intimately contacting said goods with water for up to 3½ minutes prior to contacting said goods with said acid or alkaline solutions, said water having a temperature from just above ambient to 212° F.

24. A process, as claimed in claim 12, wherein said acid solution includes whitener enhancing agents therein.

25. A process for treating cellulosic goods prior to bleaching for a time sufficient to achieve commercially acceptable whiteness in a chemical bleach solution, consisting essentially of intimately contacting said goods with water for up to 3½ minutes prior to bleaching, said water being substantially free of heavy metal ions and having a temperature from just above ambient to 212° F.

26. A process, as claimed in claim 25, wherein said water temperature is in the range 104° to 212° F.

27. A process, as claimed in claim 25, wherein said intimate contact is achieved by immersing the goods in a water bath.

28. A process as claimed in claim 25, wherein said water is selected from the group consisting of deionized and distilled water.

29. A process, as claimed in claim 25, wherein said water includes whitener enhancing agents therein.

30. A process for bleaching cotton and other cellulosic goods comprising the steps of:

(a) intimately contacting said goods with an alkaline scour solution for from 5 seconds to 3½ minutes, said alkaline scour solution having a temperature in the range 160°–212° F. and a pH from 10 to 14; and (b) immersing said goods for a time sufficient to achieve commercial brightness but less than about 30 minutes in an aqueous solution having a temperature in the range from 160° to 212° F. and comprising from 0.25 to 70% by volume hydrogen peroxide, water and sufficient hydroxide to adjust said solution to a pH in the range 2 to 14.

31. A process, as claimed in claim 30, including the step of intimately contacting said goods with water for up to 3½ minutes prior to contacting said goods with said alkaline scour solution, said water having a temperature from just above ambient to 212° F.

32. A process, as claimed in claim 30, wherein a portion of said bleach solution is cycled through a filtration means to remove solid impurities therefrom while maintaining the volume, composition and pH of said solution in contact with said goods substantially the same.

33. A process, as claimed in claim 30, wherein a portion of said alkaline scour solution is cycled through a purification means to remove impurities therefrom while maintaining the volume, composition and pH of said alkaline scour solution in contact with said goods substantially the same.

34. A process, as claimed in claim 30, including the step of intimately contacting said goods with an acid solution for from 1 to 10 seconds prior to bleaching, said acid solution having a temperature in the range 45° to 212° F. and a pH less than about 3, one of said alkaline scour and acid solutions contacting said goods first and the other contacting said goods while said goods are at about the pH of the solution which first contacted said goods.

35. A process as claimed in claim 34, including the step of intimately contacting said goods with water for up to 3½ minutes prior to contacting said goods with said acid or alkaline solutions, said water having a temperature from just above ambient to 212° F.

36. A process, as claimed in claim 35, wherein a portion of said bleach solution is cycled through a filtration means to remove solid impurities therefrom while maintaining the volume, composition and pH of said solution in contact with said goods substantially the same and wherein a portion of each of said alkaline scour solution and said acid solution is cycled through a purification means to remove impurities therefrom while maintaining the volume, composition and pH of each of said alkaline scour and acid solutions in contact with said goods substantially the same.

37. A process, as claimed in claim 34, wherein a portion of said bleach solution is cycled through a filtration means to remove solid impurities therefrom while maintaining the volume, composition and pH of said solution in contact with said goods substantially the same.

38. A process, as claimed in claim 34, wherein a portion of each of said alkaline scour and acid solution is cycled through a purification means to remove impurities therefrom while maintaining the volume, composition and pH of said respective solutions in contact with said goods substantially the same.

* * * * *